US007963472B2

(12) United States Patent
Odman et al.

(10) Patent No.: US 7,963,472 B2
(45) Date of Patent: Jun. 21, 2011

(54) INTAKE LIMITING DEVICE FOR DOCUMENT SHREDDER

(75) Inventors: Shanon T. Odman, Roann, IN (US); Bradley L. Bozarth, Wabash, IN (US)

(73) Assignee: Martin Yale Industries, Inc., Wabash, IN (US)

( * ) Notice: Subject to any disclaimer, the term of this patent is extended or adjusted under 35 U.S.C. 154(b) by 46 days.

(21) Appl. No.: 12/488,052

(22) Filed: Jun. 19, 2009

(65) Prior Publication Data

US 2010/0320301 A1 Dec. 23, 2010

(51) Int. Cl.
*B02C 18/22* (2006.01)

(52) U.S. Cl. ..... 241/225; 241/236

(58) Field of Classification Search ..... 241/236, 241/100, 224, 225, 226
See application file for complete search history.

(56) References Cited

U.S. PATENT DOCUMENTS

| | | | |
|---|---|---|---|
| 3,396,914 | A | 8/1968 | Liebman |
| 4,564,146 | A | 1/1986 | Bleasdale |
| 4,815,670 | A | 3/1989 | Iwai |
| 4,890,797 | A | 1/1990 | Fujii et al. |
| 7,234,656 | B1 | 6/2007 | Lo |
| 2004/0140382 | A1 | 7/2004 | Ho |
| 2005/0127216 | A1 | 6/2005 | Mead et al. |

*Primary Examiner* — Mark Rosenbaum
(74) *Attorney, Agent, or Firm* — Woodard, Emhardt, Moriarty, McNett & Henry LLP

(57) ABSTRACT

A shredder intake limiting device having a pair of parallel bars, wherein the ends of the bars are supported by a pair of side supports. Each side support comprises a floor surface flanked by two upwardly-diverging sidewall surfaces. The angle of the sidewall surfaces is such that the bars will be prevented from separating beyond a desired limit when sheet material is being inserted downward into the shredder. When sheet material is being pulled upward during removal after a jam, the diverging angles of the sidewall surfaces will allow the bars to travel upward and the horizontal separation distance to increase, thereby allowing the jammed material to be easily removed.

20 Claims, 10 Drawing Sheets

INTAKE LIMITING DEVICE FOR DOCUMENT SHREDDER

FIELD OF THE INVENTION

The present invention relates in general to devices for shredding sheet-type material. More particularly, the present invention relates to an intake limiting device for a document shredder.

BACKGROUND OF THE INVENTION

Document shredding devices are known in the prior art and are available in a variety of sizes and designs. Most shredders utilize sharp cutting heads for shredding the inserted material, with the cutting heads typically optimized to handle a maximum material thickness (i.e., a maximum number of paper sheets). If material having an excessive thickness reaches the cutting heads, jamming and/or damage may occur. It is therefore important to limit the overall thickness of material that may be inserted into the shredder. This is typically accomplished by placing a pair of carefully spaced rollers in the intake path prior to the cutting heads. The spacing between the rollers is fixed to prevent excessively thick material from entering.

A problem occurs, however, when an acceptable amount of material is fed through the intake rollers, but wrinkles or otherwise bunches up during the feeding process. For example, if paper is inserted in a crooked fashion, such that the side edges of the paper make contact with the side edges of the intake slot after some portion of the paper has already been engaged by the cutting heads (see FIG. 1), the paper will fold over on itself near the side edges as it is pulled through (see FIG. 2), causing a jam in the intake rollers. When this happens, the machine preferably will sense the increased resistance and stop the cutting heads to prevent possible damage. However, it is often difficult for the user to remove the paper once a jam has occurred, especially if the folded portion or "blister" has managed to get past the intake rollers before the shredder has stopped. When the user tugs on the jammed paper in an attempt to remove it, it may tear, leaving only a small, unreachable portion of paper left within the intake rollers. This not only causes frustration, but also presents a safety hazard if the user is tempted to place his hands into the shredding machine in an attempt to retrieve the torn material.

SUMMARY OF THE INVENTION

A shredder intake limiting device is disclosed, comprising two intake bars disposed in a generally parallel configuration and defining an intake opening between the intake bars for directing sheet material into a shredder. The intake bars are supported by supports which have a lower floor surface and upwardly-diverging sidewall surfaces. The initial horizontal separation of the intake bars is limited to a first maximum distance defined by the separation distance of the sidewall surfaces when the sheet material is being inserted downward into the shredder. The angle of the sidewall surfaces allows the intake bars to travel upward and the horizontal separation distance of the intake bars to increase beyond the first maximum distance when sheet material is being removed from the shredder in an upward direction.

According to another aspect of the disclosure, a shredder intake limiting device is disclosed, comprising two intake bars disposed in a generally parallel configuration and defining an intake opening between the intake bars for directing sheet material into the shredder. The intake bars are supported in slots defined in the supports, the slots being angled in an upwardly-diverging fashion, with each one of the slots having an upper and lower end. The initial horizontal separation of the intake bars is limited to a first maximum distance when the intake bars are resting in the lower ends of the slots and the sheet material is being inserted downward into the shredder. The angle of the slots allows the intake bars to travel upward and the horizontal separation distance of the intake bars to increase beyond the first maximum distance when sheet material is being removed from the shredder in an upward direction.

According to another aspect of the disclosure, a device is disclosed, comprising a housing, two rotatable interlocking cutting heads mounted within the housing for shredding sheet material, and two intake bars disposed in a generally parallel configuration above the cutting heads and defining an intake opening between the intake bars for directing sheet material into the cutting heads. The intake bars are supported by supports which have a lower floor surface and upwardly-diverging sidewall surfaces. The horizontal separation distance of the intake bars is limited to a first maximum distance by the angled sidewall surfaces when the sheet material is being inserted downward into the shredder. The angle of the sidewall surfaces allows the intake bars to travel upward and the horizontal separation distance of the intake bars to increase beyond the first maximum distance when sheet material is being removed from the device in an upward direction.

DESCRIPTION OF PREFERRED EMBODIMENTS

Figure 1:
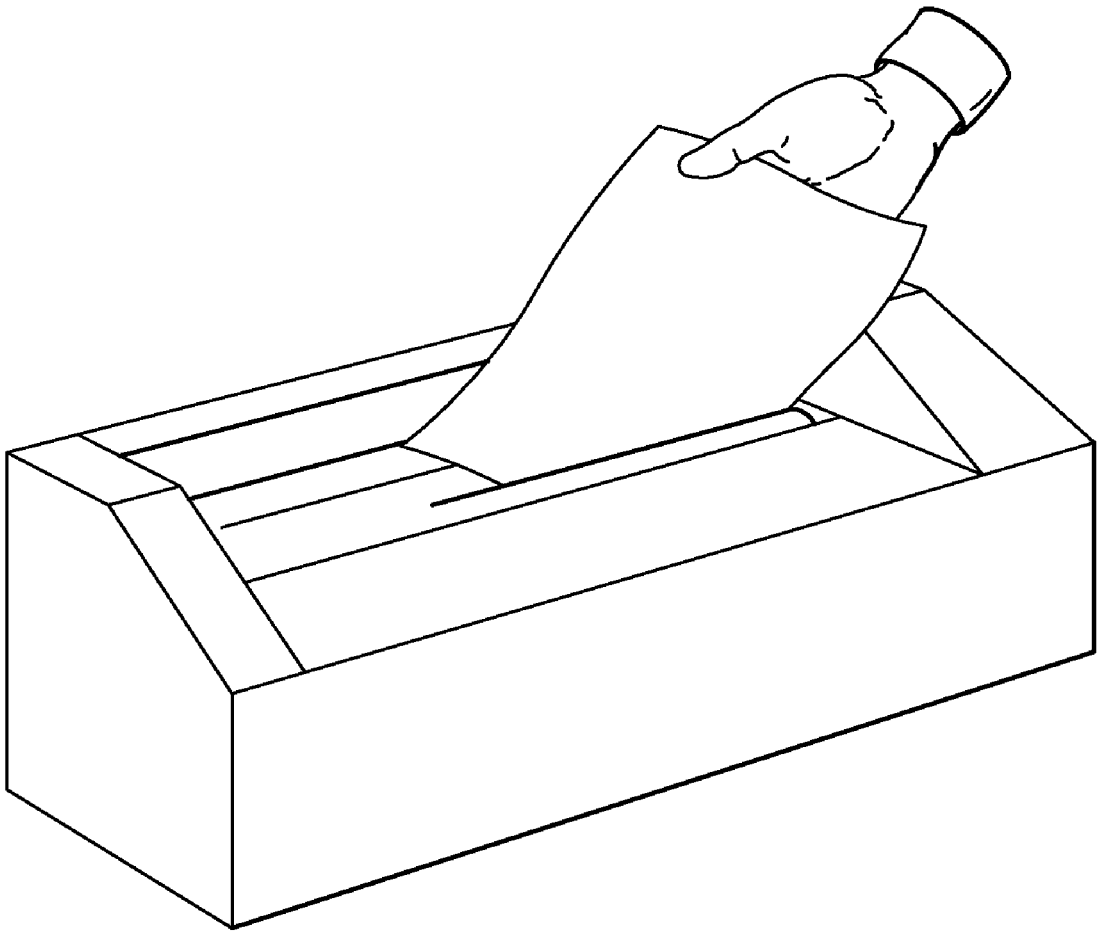
FIG. 1 is a perspective view of a shredder as paper is being inserted in a crooked fashion.
Figure 2:
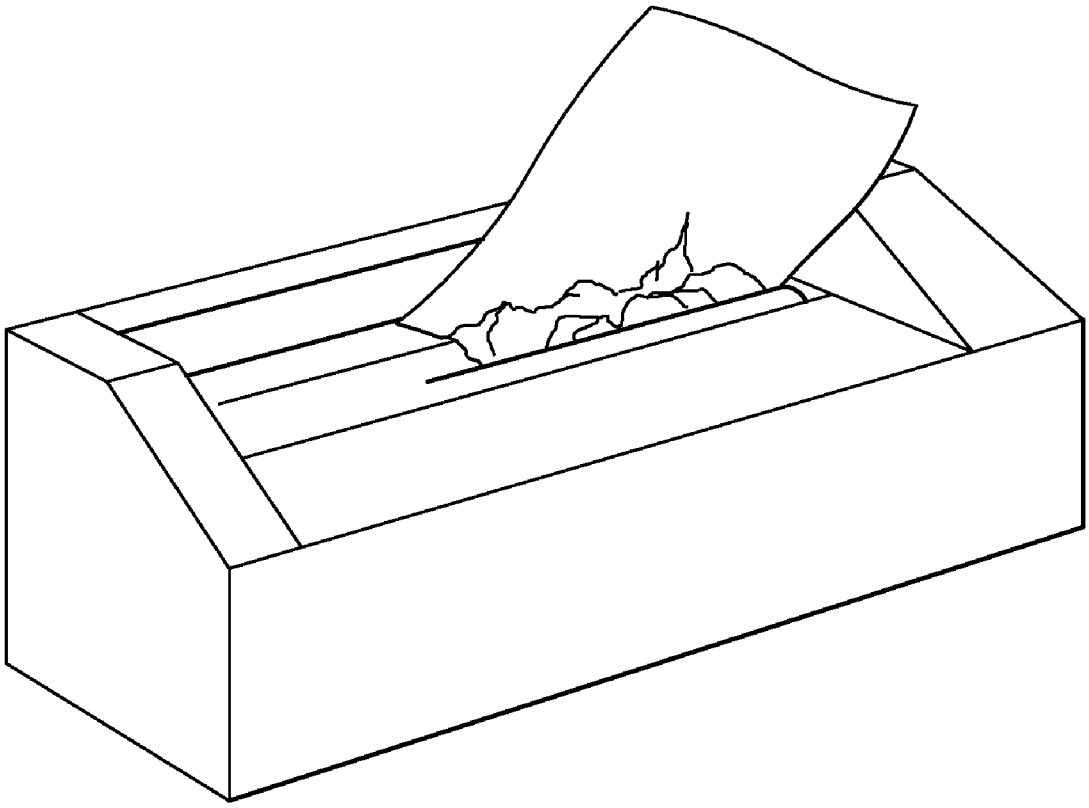
FIG. 2 is a perspective view of the shredder of FIG. 1 after the paper has wrinkled due to crooked insertion and caused a jam condition.

For the purposes of promoting an understanding of the principles of the invention, reference will now be made to the embodiment illustrated in the drawings and specific language will be used to describe the same. It will nevertheless be understood that no limitation of the scope of the invention is thereby intended. Alterations and modifications in the illustrated device, and further applications of the principles of the invention as illustrated therein are herein contemplated as would normally occur to one skilled in the art to which the invention relates.

Figure 3:
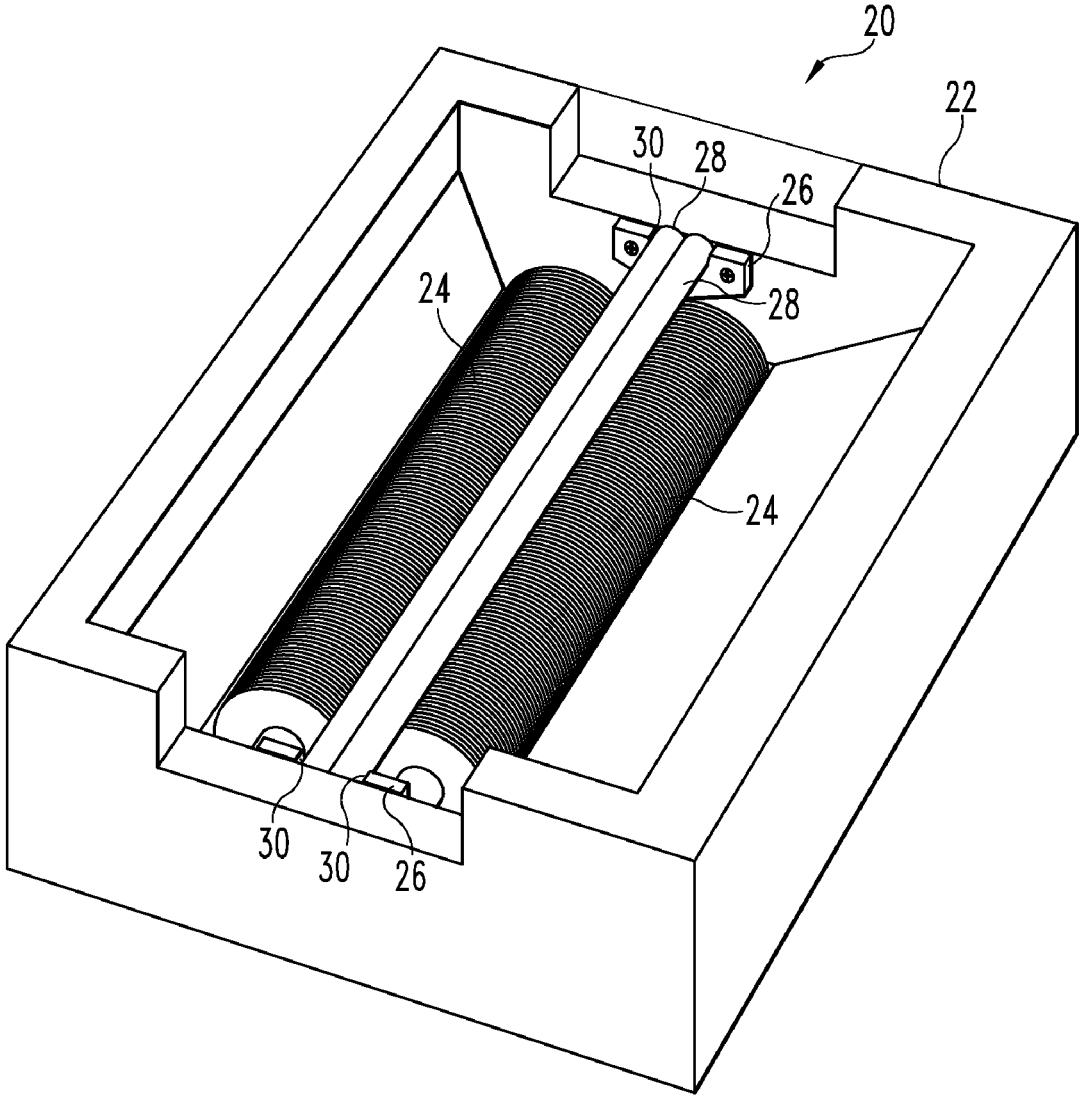
FIG. 3 is a perspective view of a shredder with the cover removed and containing an intake limiting device according to one embodiment of the present disclosure.

Referring to FIG. 3, a perspective view of a shredder 20 according to one embodiment of the present disclosure is shown. Shredder 20 includes a housing 22 within which cutting heads 24 are mounted. The cutting heads 24 may comprise rotating cylinders or plates having cutting teeth or any other cutting means known in the art. In order to limit the overall thickness of material that can be inserted into the cutting heads 24, a pair of cylindrical intake bars 28, which are supported by side supports 26, are installed above the cutting heads 24. The intake bars 28 are preferably retained within a recessed portion of the side supports 26, with the horizontal movement or separation of the intake bars being limited by the sidewall surfaces 30 of the side supports 26. In one aspect, the intake bars are not directly secured to the supports and may freely move within containment limits.

In one embodiment, the length of the intake bars 28 is approximately 13 inches and the thickness of the side supports 26 is approximately one-half inch. This allows for approximately twelve inches of space between the side supports 26 when installed in the shredder 20, which is typically enough space for 8½×11 or A4 sheet material to be inserted. In other embodiments, the spacing between the side supports 26 and the length of the intake bars 28 may be made larger or smaller depending on the intended size of material to be shredded.

Figure 4:
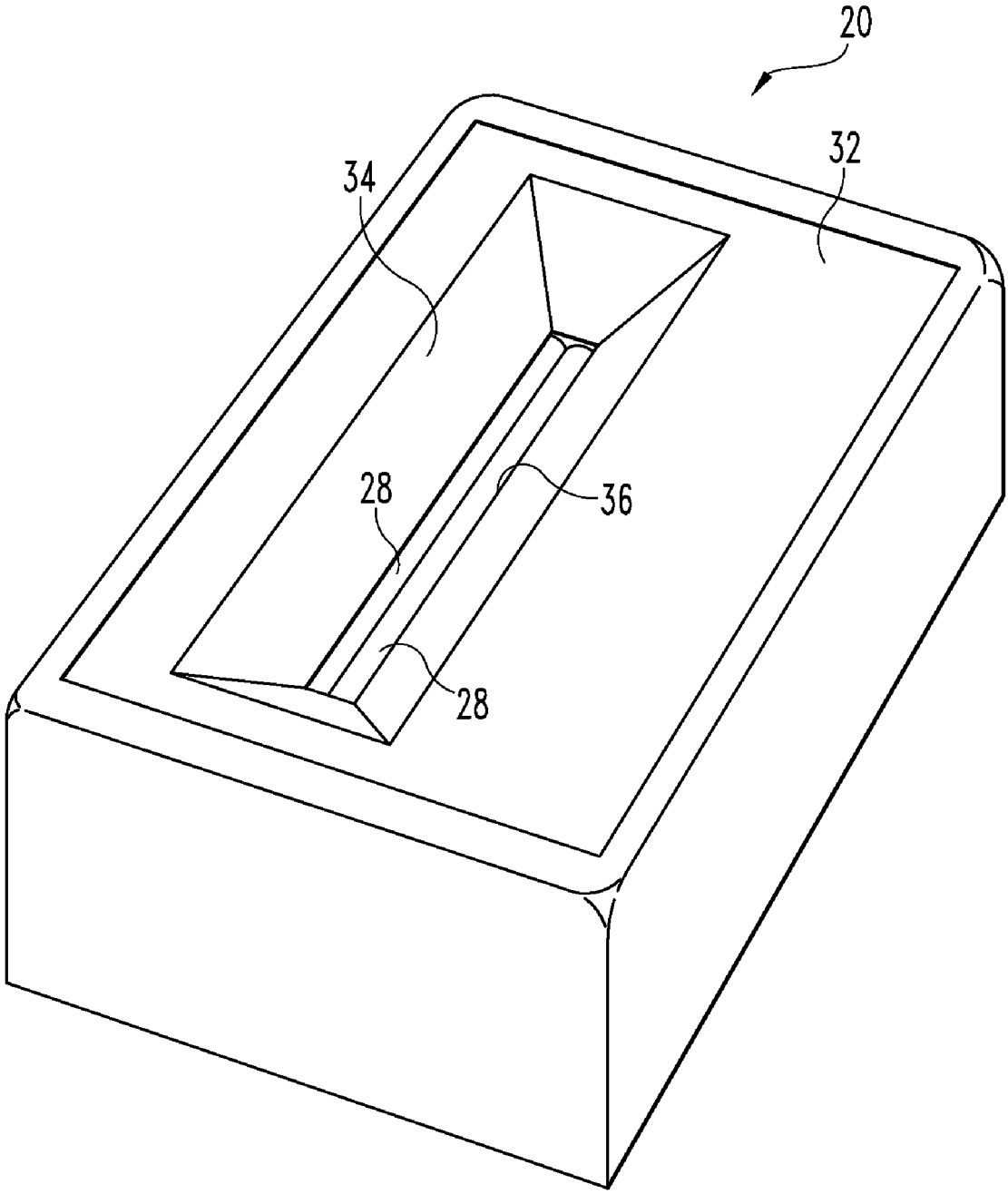
FIG. 4 is a perspective view of the shredder of FIG. 3 with the cover installed.

FIG. 4 illustrates the shredder 20 with a cover 32 installed. The cover 32 has an angled recessed portion 34, which defines an opening 36 above the intake bars 28. The opening 36 is large enough to allow sheet material to be inserted between the intake bars 28 and into the cutting heads 24, yet small enough to limit the upward travel of the intake bars 28 during removal of sheet material when a jam occurs. It shall be understood that other means for limiting the upward travel of the intake bars may be employed.

Although not shown for ease of illustration, the shredder 20 may comprise other components necessary to effectuate the shredding of material including motors, power supplies, sensors, and user controls. In addition, the shredder 20 may be configured to be a portable unit for desktop use, or a free-standing unit for more rigorous applications.

Figure 5:
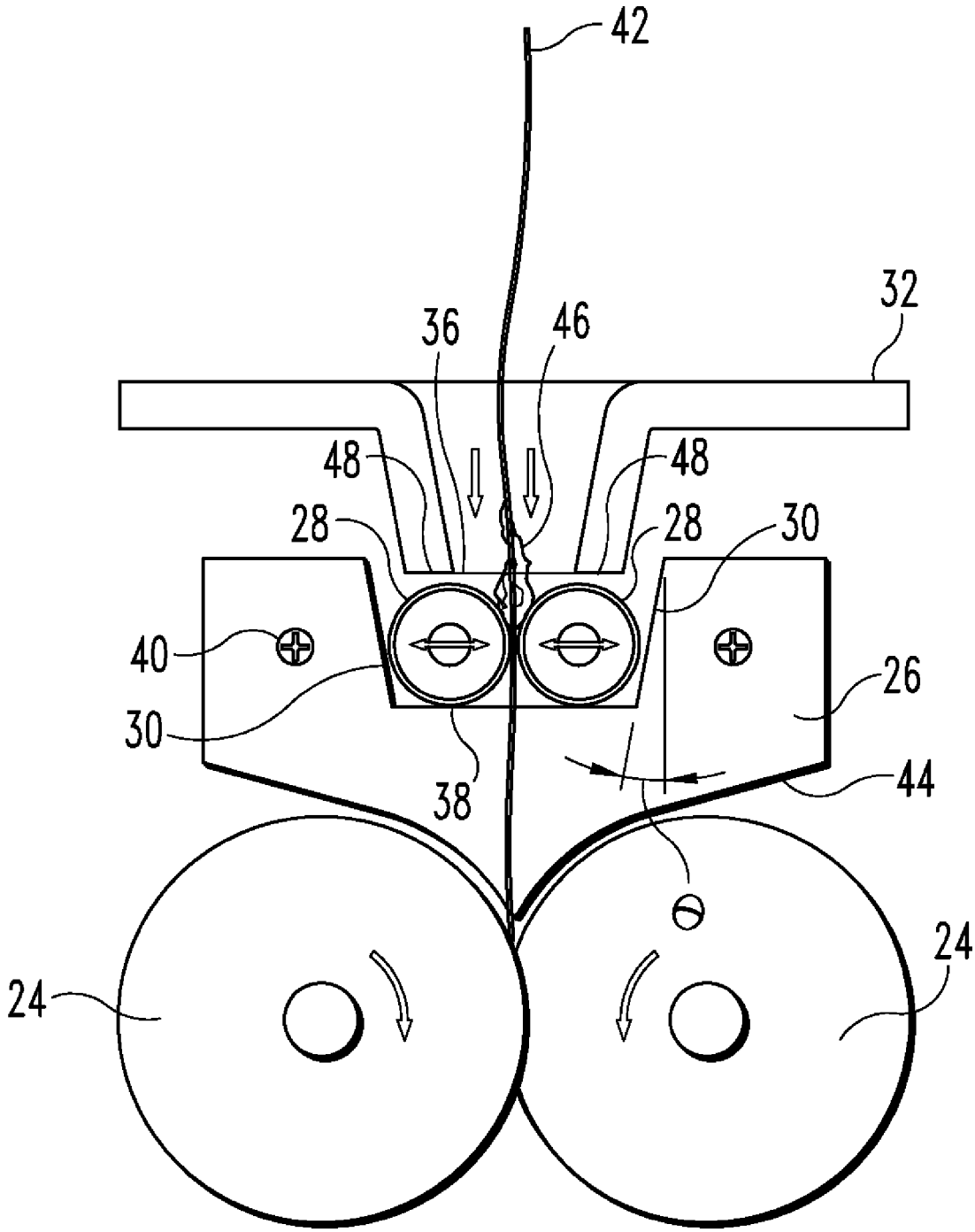
FIG. 5 is a side view of the shredder intake limiting device of FIG. 3 after paper has been misfed, causing a jam condition.

Turning to FIG. 5, an internal side view of a portion of the shredder 20 is shown. Again, intake bars 28 are positioned to rest upon a lower floor surface 38 of side supports 26. The intake bars 28, side supports 26, and cover 32 may be made of metal, plastic, or any suitable material known in the art. The side supports 26 may be mounted to the housing 22 using fasteners 40. Fasteners 40 may comprise screws, bolts, or another suitable fastener known in the art. In other embodiments, the side supports 26 may be formed integral to the housing 22.

Intake bars 28 are free to move along floor surface 38 to the initial limits established by the inner sidewall surfaces 30 of side supports 26. The diameter of the intake bars 28, the length of the floor surface 38, and the angle of the sidewall surfaces 30 are chosen to allow a selected maximum thickness of sheet material 42 to be inserted between the intake bars 28 when the intake bars 28 are in contact with the floor surface 28. In a preferred embodiment, the maximum separation of the intake bars 28 during insertion is 0.44 inches, which allows up to ten sheets of 20# paper to be inserted. In other embodiments, the maximum separation during material insertion may be more or less than 0.44 inches, depending on the intended use of the shredder 20.

Figure 6:
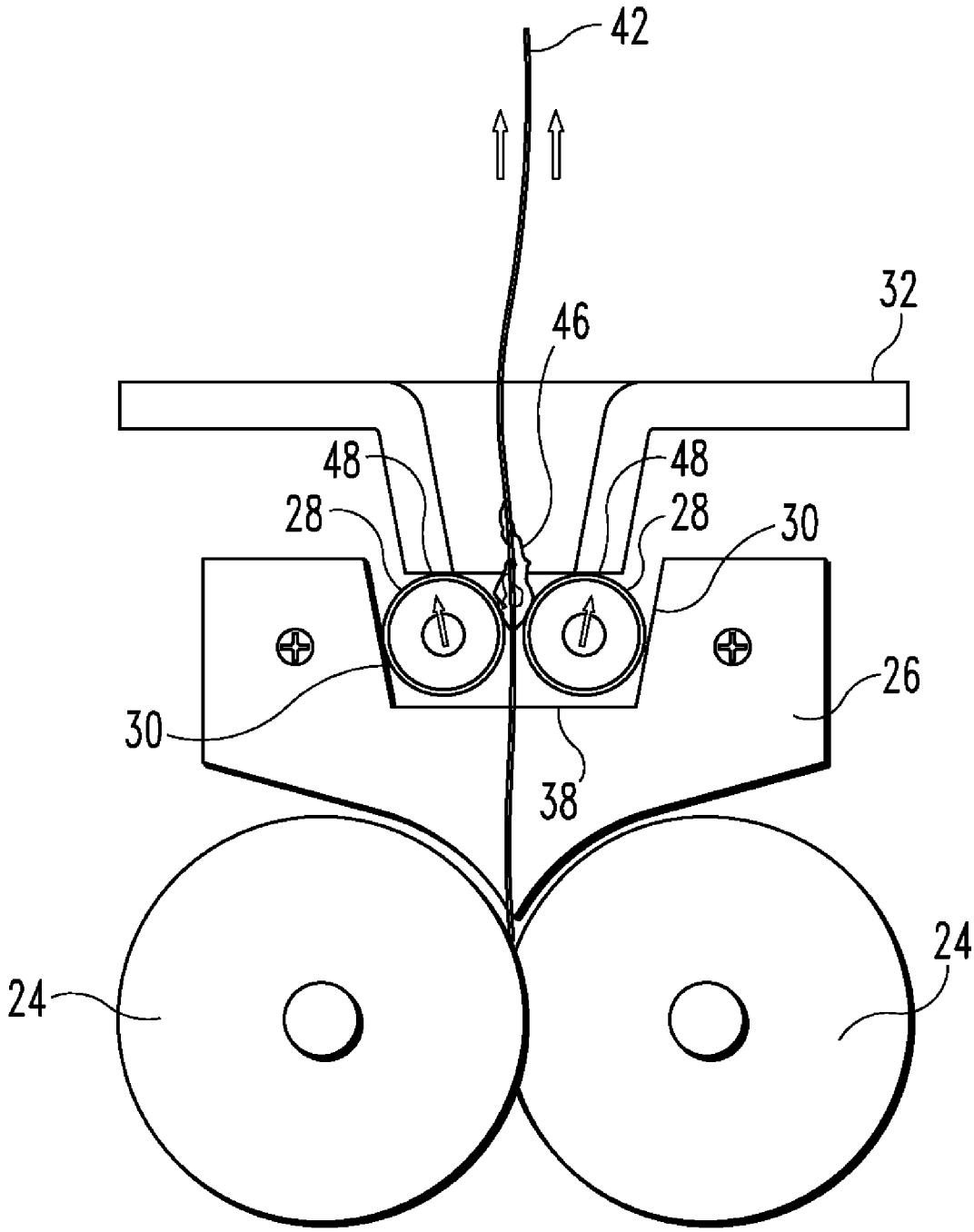
FIG. 6 is a side view of the shredder intake limiting device of FIG. 3 as the jammed paper is being removed from the device.

The angle θ (see FIG. 5) of the sidewall surfaces 30 is sufficiently vertical to prevent the intake bars 28 from lifting off of the floor surface 38 when a typical horizontal outward force is applied due to sheet material 42 being inserted in a downward direction between the intake bars 28. However, the angle θ of the sidewall surfaces diverges from vertical to allow the intake bars to separate beyond the initial maximum insertion separation distance when the intake bars 28 and sheet material 42 are pulled upward during removal as shown in FIG. 6. As the height of the intake bars 28 increases, the angled sidewall surfaces 30 allow a greater horizontal separation distance. In one embodiment, the angle θ of the sidewall surfaces 30 is less than fifteen degrees from vertical, however the angle θ may be larger or smaller in alternative embodiments. In a further embodiment, the angle θ of the sidewall surfaces 30 is approximately ten degrees from vertical.

In certain embodiments, the bottom surface 44 of side supports 26 may be curved to match the upper profile of the cutting heads 24, thereby minimizing the required distance between the intake bars 28 and the cutting heads 24 while maintaining an adequate structural thickness of the side supports 26. The intake bars 28 may be tubular and hollow, as shown in FIG. 5, or solid. In a preferred embodiment, the intake bars 28 are cylindrical with a circular cross-sectional shape. In alternative embodiments, the cross-sectional shape of the intake bars 28 may be square or any other shape.

In normal operation, sheet material 42 is fed through opening 36 of cover 32, between the intake bars 28, and into the cutting heads 24, where it is shredded. The shredded material then drops into a collection bin below (not shown). If the overall thickness of the sheet material 42 is within the design maximum, the intake bars 28 will ride freely to separate and/or optionally roll on floor surface 38 and will allow the sheet material 42 to pass through. By contrast, if the overall thickness of the sheet material 42 is beyond the design maximum, the sidewall surfaces 30 will limit the horizontal separation of the intake bars 28 and prevent the sheet material from moving further towards the cutting heads 24.

If, however, the inserted material 42 thickness is initially within the design maximum, but wrinkles or folds over on itself after a portion of the material 42 has passed between the intake bars 28 and reached the cutting heads 24, the cutting heads 24 will continue to pull the material 42 downward until the thickened portion 46 of the material 42 creates a tension in the material 42 between the cutting heads 24 and the intake bars 28, as shown in FIG. 5. When the tension becomes great enough, the shredder 20 will preferably shut down to protect the cutting heads 24 from damage.

After a jam has occurred, the user may pull upward on the sheet material 42 for removal. As shown in FIG. 6, the upward force of the sheet material 42 on the intake bars 28 will cause the intake bars 28 to travel upward. The angle of the sidewall surfaces 30 will allow a simultaneous increased horizontal separation distance between the intake bars 28, thereby preferably freeing the sheet material 42. The bottom surface 48 of the cover 32 or another movement limiter prevents the intake bars 28 from rising beyond a desired maximum vertical distance. The mounting distance between the surfaces 38 and 48 in relation to the diameter of the intake bars 28, in conjunction with the angle of the sidewall surfaces 30, is chosen to provide the desired increase in horizontal separation between the intake bars 28 when a typical thickness of jammed material 42 is being removed.

In certain embodiments, shredder 20 may be able to automatically reverse the direction of the cutting heads 24 when a jam condition is sensed. The reversing cutting heads 24 will cause the jammed material to move upwards, with the intake bars 28 automatically separating horizontally as a result. Alternatively, the cutting heads can be manually reversed or disengaged to allow jammed sheet material to be removed from the shredder.

Figure 7:
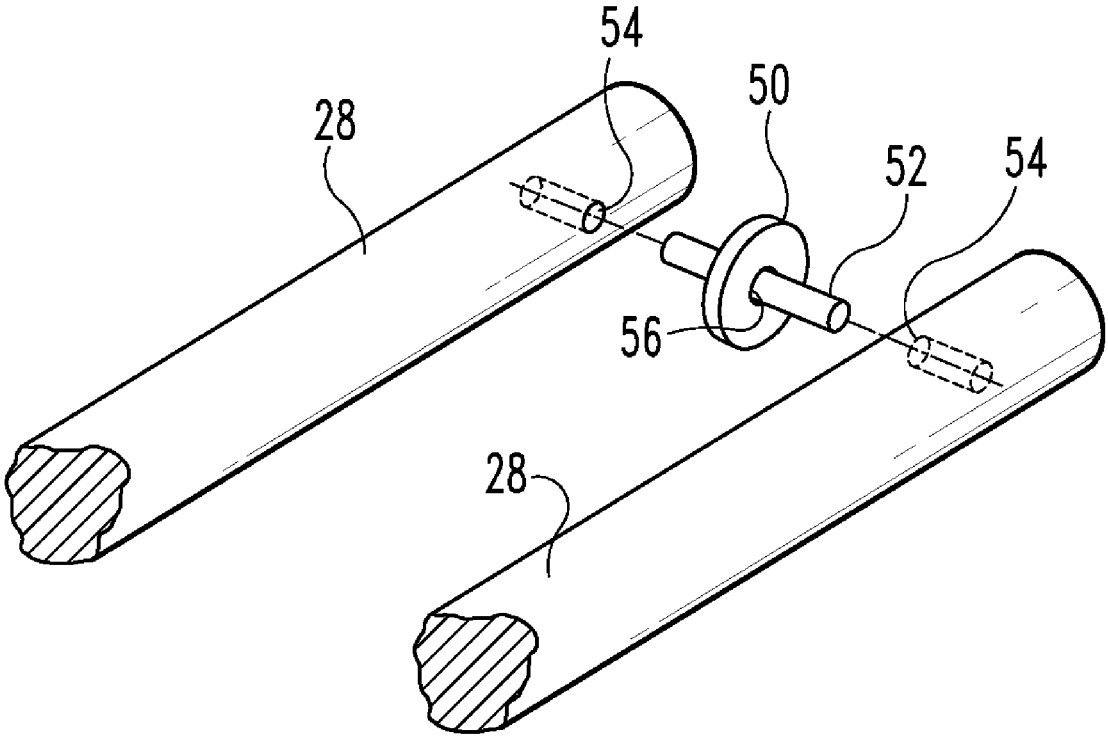
FIG. 7 is a perspective view of a spacer assembly within the shredder intake limiting device of FIG. 3 according to one embodiment of the present disclosure.
Figure 8A:
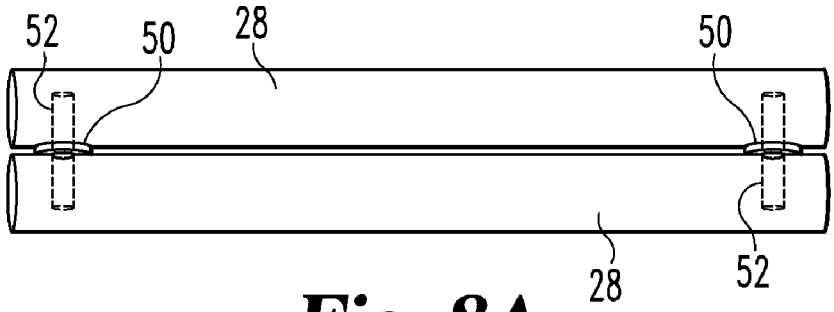
FIG. 8A is a side view of the spacer assembly of FIG. 7 is when installed within the intake rollers.
Figure 8B:
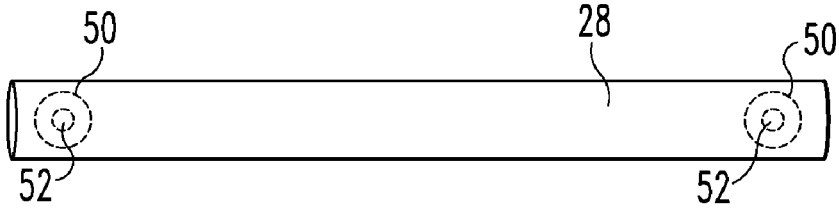
FIG. 8B is a top view of the spacer assembly of FIG. 7 is when installed within the intake rollers.
Figure 8C:
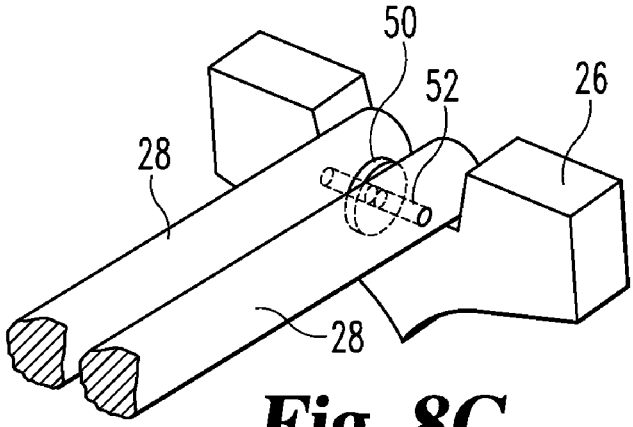
FIG. 8C is a perspective view of the spacer assembly of FIG. 7 is when installed within the intake rollers.

FIG. 7 shows a perspective view of an optional spacer 50 for maintaining a minimum separation of the intake bars 28 according to one embodiment of the present disclosure. In the illustrated embodiment, the spacer 50 is supported by a pin 52 which rides within opposing holes 54. The holes 54 are formed in the cylindrical surface of each intake bar 28 near the ends of the intake bars 28. The diameter of the pin 52 is preferably slightly smaller than the diameter of holes 54 and the inner diameter 56 of the spacer 50 to allow the pin to be loosely fit within holes 54 and 56, thereby allowing the intake bars 28 to move horizontally as sheet material 42 is inserted and removed from the shredder 20. The length of pin 52 is preferably chosen to be slightly less than twice the diameter of intake bars 28 to prevent the pin 52 from becoming dislodged from the intake bars 28 during operation. FIGS. 8A, 8B and 8C show a side view, top view, and perspective view, respectively, of the spacer 50 and pin 52 installed with intake bars 28.

It shall be appreciated that while spacer 50 is illustrated here as a round washer and pin arrangement, other types of spacers may be utilized to maintain a minimum separation of the intake bars 28. For example, the spacer 50 and pin 52 may be formed integrally as one piece. The function of the spacer 50 may also be accomplished by forming a raised portion of material near the center of the floor surface 38.

In certain embodiments, the thickness of the spacer 50 and the outer diameter of the intake bars 28 are chosen such that each intake bar 28 will be touching an angled sidewall 30 while resting on the lower floor surface 38 of side supports 26, with the spacer 50 simultaneously touching the outer diameters of the intake bars 28. In other embodiments, the dimensions of the above components will be sized to allow some horizontal movement of the intake bars 28 while resting on the floor surface 38.

Figure 9A:
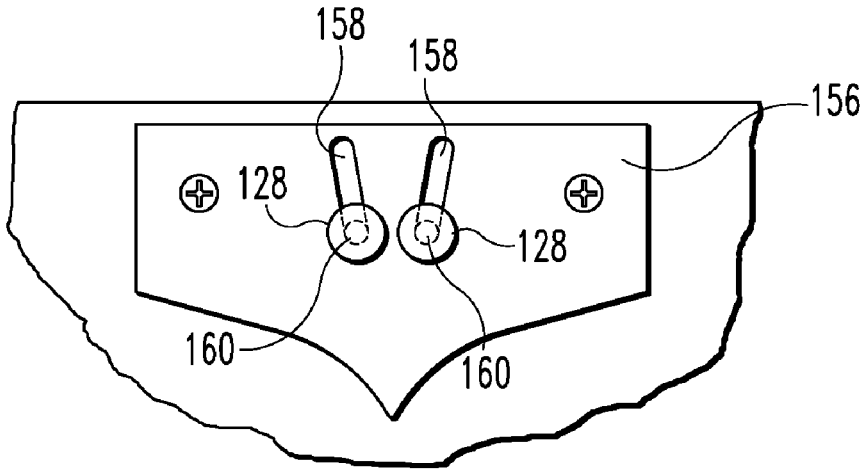
FIG. 9A is a front view of a shredder intake limiting device utilizing angled slots according to one embodiment of the present disclosure.
Figure 9B:
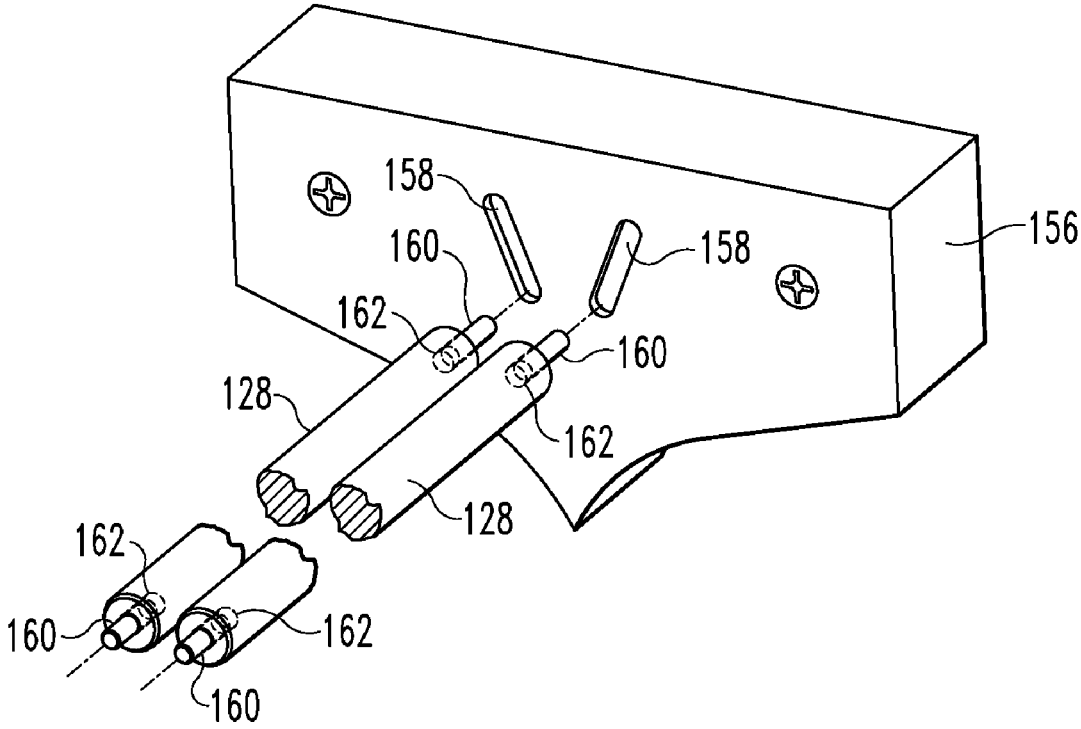
FIG. 9B is a perspective view of the shredder intake limiting device of FIG. 9A.

It shall be further appreciated that while the upward movement and outward separation of the removal path of the intake bars is accomplished by the angled surfaces 30 of side supports 26, other means for allowing upward and outward movement of the intake bars 28 during removal may be utilized. For example, slotted side supports 156 may be provided to support the intake bars 128, as shown from a front and perspective view, respectively, in FIGS. 9A and 9B. The slotted side supports 156 define slots 158, with the slots 158 diverging in the upward direction at an angle similar to the sidewall surfaces 30 of side supports 26. The intake bars 128 may optionally be fitted with axles 160 which ride within the slots 158, thereby allowing the intake bars 128 to separate when being forced upward during removal of the sheet material 42. In one option, the axles 160 may be biased with a spring in a longitudinally-outward direction such that the axles 160 may be pushed into longitudinal recesses 162 within the body of the intake bars 128 during installation and removal and expand when released. The relative horizontal spacing between the slots 158 may be chosen to provide a desirable gap between the intake bars 128 when the intake bars 128 are resting at the bottom of the slots 158. Again, the size of the gap is dependent on the desired maximum allowable thickness of material that can be accommodated by the cutting heads 24.

Figure 10A:
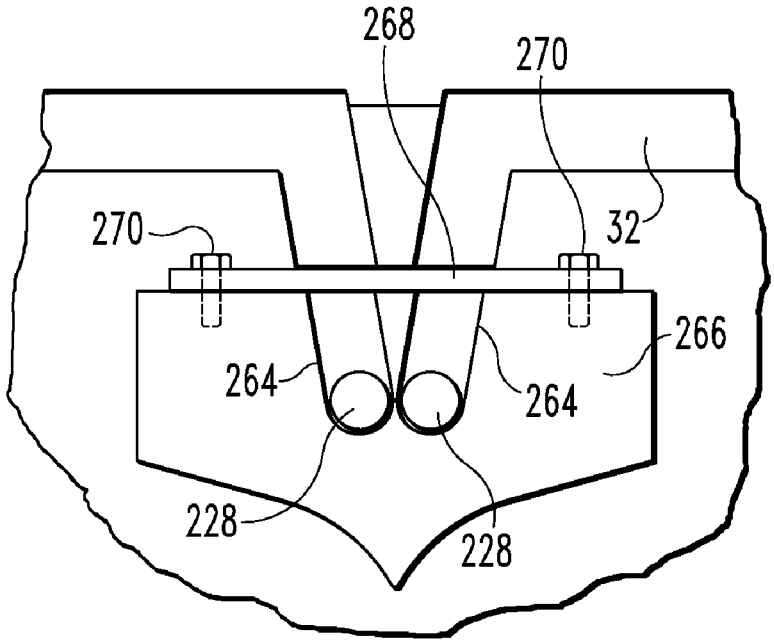
FIG. 10A is a front view of a shredder intake limiting device wherein the upper end of the angled slots is open to the top according to one embodiment of the present disclosure.
Figure 10B:
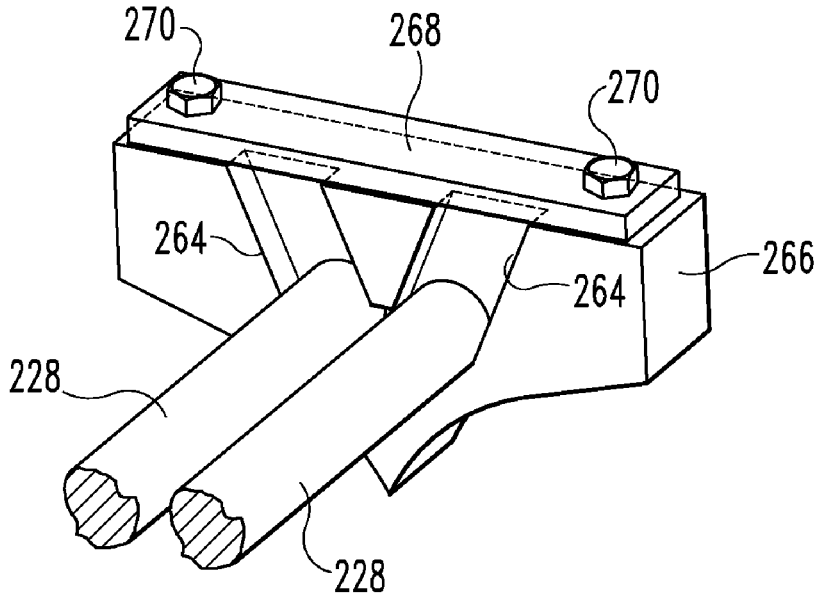
FIG. 10B is a perspective view of the shredder intake limiting device of FIG. 10A.

FIGS. 10A and 10B show a side view and perspective view, respectively, of another embodiment wherein angled slots 264 within side supports 266 are sized to receive the full diameter of the intake bars 228, with the intake bars 228 being provided without axles and the ends of the intake bars 228 riding within the slots 264. The upper ends of slots 264 may optionally be open to the top of the side supports 266 to allow the intake bars to be installed and removed through the open end of the slots 264. Top member 268 may be attached to side supports 266 using fasteners 270 to prevent the intake bars 228 from rising out of the slots 264 when jammed material is being removed from the shredder. It shall be understood that other means for limiting the upward travel of the intake bars 228 may also be employed, including, but not limited to, a cover similar to the cover 32 shown in FIG. 4.

While the invention has been illustrated and described in detail in the drawings and foregoing description, the same is to be considered as illustrative and not restrictive in character. Only the preferred embodiment, and certain alternative embodiments deemed useful for further illuminating the preferred embodiment, have been shown and described. All changes and modifications that come within the spirit of the invention are desired to be protected.

What is claimed is:

1. A shredder intake limiting device comprising:

two intake bars disposed in a generally parallel configuration and defining an intake opening between said intake bars for directing sheet material into a shredder;

wherein said intake bars are supported by supports, said supports having a lower floor surface and upwardly-diverging sidewall surfaces;

wherein the initial horizontal separation of the intake bars is limited to a first maximum distance defined by the separation distance of said sidewall surfaces when the sheet material is being inserted downward into the shredder; and wherein the angle of the sidewall surfaces allows the intake bars to travel upward and the horizontal separation distance of the intake bars to increase beyond said first maximum distance when sheet material is being removed from the shredder in an upward direction.

2. The device of claim 1, further comprising:

a cover mounted above said intake bars and said supports, said cover having an opening configured above said intake bars, wherein said cover limits the upward travel of said intake bars.

3. The device of claim 1, further comprising a top member attached to said supports, wherein said top member limits the upward travel of said intake bars.

4. The device of claim 1, wherein the angle of the sidewall surfaces is less than fifteen degrees from vertical.

5. The device of claim 1, wherein the angle of the sidewall surfaces is approximately ten degrees from vertical.

6. The device of claim 1, wherein said floor surface is horizontal.

7. The device of claim 1, further comprising:

at least one spacer for maintaining a minimum separation distance between said intake bars.

8. The device of claim 1, further comprising two spacers, a first one of said spacers disposed near a first end of the intake bars, a second one of said spacers disposed near a second end of said intake bars, said spacers defining a minimum separation distance between the intake bars.

9. The device of claim 8, further comprising two pins for supporting said spacers;

wherein each one of the intake bars further comprises a first hole in the surface of the intake bar near the first end of the intake bar and a second hole in the surface of the intake bar near the second end of the intake bar;

wherein each spacer comprises a washer having a central hole through which said pin is inserted; and wherein each pin is inserted into and supported by said first hole and said second hole.

10. A shredder intake limiting device comprising:

two intake bars disposed in a generally parallel configuration and defining an intake opening between said intake bars for directing sheet material into a shredder;

wherein said intake bars are supported in slots defined in supports, said slots being angled in an upwardly-diverging fashion, each one of said slots having an upper and lower end;

wherein the initial horizontal separation of the intake bars is limited to a first maximum distance when the intake bars are resting in the lower ends of the slots and the sheet material is being inserted downward into the shredder; and wherein the angle of the slots allows the intake bars to travel upward and the horizontal separation distance of the intake bars to increase beyond said first maximum distance when sheet material is being removed from the shredder in an upward direction.

11. The device of claim 10, wherein the angle of the slots is less than fifteen degrees from vertical.

12. The device of claim 10, wherein the angle of the slots is approximately ten degrees from vertical.

13. The device of claim 10, wherein the intake bars further comprise axles which engage said slots at each end of the intake bars; and wherein the width of the slots and the diameter of the axles are sized to allow the axles to ride freely within the slots.

14. The device of claim 13, wherein the axles are biased with a spring in a longitudinally-outward direction from the end of the axles; and wherein the axles may be pushed into a longitudinal recess within the ends of the axles.

15. The device of claim 10, wherein the upper ends of the slots are open to allow the intake bars to be installed into and removed from the slots.

16. The device of claim 15, further comprising a cover mounted above said intake bars and said supports, said cover having an opening configured above said intake bars, wherein said cover limits the upward travel of said intake bars.

17. The device of claim 10, further comprising a top member attached to said supports, wherein said top member limits the upward travel of said intake bars.

18. A device, comprising:

a housing;

two rotatable interlocking cutting heads mounted within the housing for shredding sheet material;

two intake bars disposed in a generally parallel configuration above said cutting heads and defining an intake opening between said intake bars for directing sheet material into the cutting heads;

wherein said intake bars are supported by supports, said supports having a lower floor surface and upwardly-diverging sidewall surfaces;

wherein the horizontal separation distance of the intake bars is limited to a first maximum distance by the angled sidewall surfaces when the sheet material is being inserted downward into the device; and wherein the angle of the sidewall surfaces allows the intake bars to travel upward and the horizontal separation distance of the intake bars to increase beyond, said first maximum distance when sheet material is being removed from the device in an upward direction.

19. The device of claim 18, further comprising:

a cover mounted above said intake bars and said supports, said cover having an opening configured above said intake bars, wherein said cover limits the upward travel of said intake bars.

20. The device of claim 18, wherein the angle of the sidewall surfaces is less than fifteen degrees from vertical.

* * * * *